US009233400B2

(12) United States Patent
Smith et al.

(10) Patent No.: US 9,233,400 B2
(45) Date of Patent: Jan. 12, 2016

(54) SYSTEMS AND METHODS FOR AGGREGATING SERIALIZED GOODS

(71) Applicant: Covectra, Inc., Westborough, MA (US)

(72) Inventors: Richard Smith, Pottstown, PA (US); Stephen M. Wood, Waterford, CT (US)

(73) Assignee: Covectra, Inc., Westborough, MA (US)

( * ) Notice: Subject to any disclaimer, the term of this patent is extended or adjusted under 35 U.S.C. 154(b) by 0 days.

(21) Appl. No.: 14/301,583

(22) Filed: Jun. 11, 2014

(65) Prior Publication Data

US 2014/0360924 A1 Dec. 11, 2014

Related U.S. Application Data

(60) Provisional application No. 61/833,569, filed on Jun. 11, 2013.

(51) Int. Cl.

| | |
|---|---|
| ***B07C 5/34*** | (2006.01) |
| ***B07C 5/38*** | (2006.01) |
| ***B07C 5/342*** | (2006.01) |
| ***B07C 5/36*** | (2006.01) |

(52) U.S. Cl.

CPC ..... *B07C 5/34* (2013.01); *B07C 5/3412* (2013.01); *B07C 5/3422* (2013.01); *B07C 5/362* (2013.01); *B07C 5/38* (2013.01)

(58) Field of Classification Search

CPC ..... B07C 3/02; B07C 3/04; B07C 3/06; B07C 3/08; B07C 3/082; B07C 5/342; B07C 5/3422; B07C 5/362; B07C 5/3412; B07C 5/38

USPC ..... 209/576, 577, 579, 583, 584, 587, 656, 209/657, 689, 690, 939

See application file for complete search history.

(56) References Cited

U.S. PATENT DOCUMENTS

| | | | | |
|---|---|---|---|---|
| 3,747,755 | A * | 7/1973 | Senturia et al. | 209/559 |
| 5,078,258 | A * | 1/1992 | van der Schoot | 198/384 |
| 5,275,272 | A | 1/1994 | Ydoate | |
| 5,522,512 | A | 6/1996 | Archer et al. | |
| 5,794,788 | A * | 8/1998 | Massen | 209/524 |
| 6,996,538 | B2 | 2/2006 | Lucas | |
| 8,428,773 | B1 | 4/2013 | Carr et al. | |
| 2003/0176942 | A1 | 9/2003 | Sleep et al. | |
| 2004/0084280 | A1 | 5/2004 | Ogle et al. | |
| 2007/0219916 | A1 | 9/2007 | Lucas | |
| 2011/0220458 | A1 | 9/2011 | Sng et al. | |
| 2012/0068701 | A1 | 3/2012 | Chisholm et al. | |

OTHER PUBLICATIONS

OptelVision "Track and Trace," downloaded from http://www.optelvision.com/track-and-trace-serialization on Jun. 11, 2014, total 3 pgs.

(Continued)

*Primary Examiner* — David H Bollinger
(74) *Attorney, Agent, or Firm* — Cooley LLP

(57) ABSTRACT

In some embodiments, aggregated serialized goods may be loaded into the serialization/aggregation system via a conveyor, and the aggregated serialized goods may be scanned and authenticated. The aggregated serialized goods that are determined to be authentic may be diverted to at least one aggregation line, where the aggregated serialized goods may be bundled. The serialization/aggregation system may be adjustable, and may be easily converted to accept items of various shapes and sizes.

24 Claims, 3 Drawing Sheets

(56) References Cited

OTHER PUBLICATIONS

Seidenader, "Track and Trace Solutions: Serialization and e-pedigree on pharmaceutical packaging lines", downloaded from http://www.seidenader.de/en/solutions/tracktrace.html on Jun. 10, 2014, total 1 pg.

Seidenader, "Never Lose Track 360' at a Glance", downloaded from http://www.seidenader.de/en/news/press-releases/news/article/never-lose-track-360-at-a-glance.html on Jun. 10, 2014, total 2 pgs.

International Search Report and Written Opinion for International Application No. PCT/US2014/041873, mailed Oct. 29, 2014, 10 pages.

* cited by examiner

SYSTEMS AND METHODS FOR AGGREGATING SERIALIZED GOODS

CROSS REFERENCE TO RELATED APPLICATIONS

This application claims priority to and benefit of U.S. Provisional Application Ser. No. 61/833,569, filed Jun. 11, 2013, entitled "Systems and Methods for Aggregating Serialized Goods," the disclosure of which is hereby incorporated by reference in its entirety.

BACKGROUND

Embodiments described herein relate generally to systems, devices and methods for serializing and subsequent aggregation of serialized goods such as, for example, pharmaceutical products to allow tracking and tracing of goods with high fidelity.

Product counterfeiting and diversion is typically a major concern for manufacturers. In particular, product counterfeiting in the pharmaceutical industry can result in substantially less revenue for pharmaceutical companies and can jeopardize the health and confidence of patients taking medication. According to the World Health Organization (WHO), up to 15 percent of all medical products in the world are estimated to be counterfeits and the problem is rising. In order to combat counterfeit products, new standards for tracking and tracing medical products need to be developed and implemented globally.

A known method for preventing counterfeiting and diversion, misuse and abuse of pharmaceutical and medical device products is serialization. Serialization is the process of creating and applying unique traceable serial numbers, for example, bar codes to goods such as medical products, at each packaging stage. For example, the unique traceable serial numbers can be applied to bottles or boxes, and aggregates of products such as, for example, bundles, cases, and/or pallets. This information can be managed, stored digitally/electronically and exchanged with key stake holders in the product packaging line and distribution supply chain to ensure that only authentic products are delivered to consumers.

Recent and pending government regulatory requirements are requesting implementation of global drug traceability systems to fight counterfeiting and diversion. This will protect public health against illicit product introduction within the supply chain. Many pharmaceutical and biomedical manufacturers are, however, discovering that their legacy packaging systems are not configured to support the new serialization and track and trace requirements. Most existing packaging lines have manual packaging operations and product manufacturers are reluctant to upgrade their packaging capabilities to be compatible with serialization and tracking systems due to concerns about significant cost impact of such modifications and development of customized packaging lines for one specific product and package size.

Therefore, there is a need for new systems, devices and methods for serializing and aggregating serialized goods products which can relatively easily integrate into existing manual packaging lines of medical product manufacturers. There is also a need for new portable systems that can be moved from one packaging suite or area to another.

SUMMARY

In some embodiments, goods may be loaded into an aggregation/serialization system. The goods may be transported by a conveyor through an imaging system, where the items are identified and authenticated. The goods deemed to be unauthentic may be rejected, while those determined to be authentic may be diverted to at least one aggregation line, where the serialized goods are aggregated. The serialization/aggregation system may be adjustable, and may be easily converted to accept goods of various shapes and sizes.

DETAILED DESCRIPTION

Figure 1:
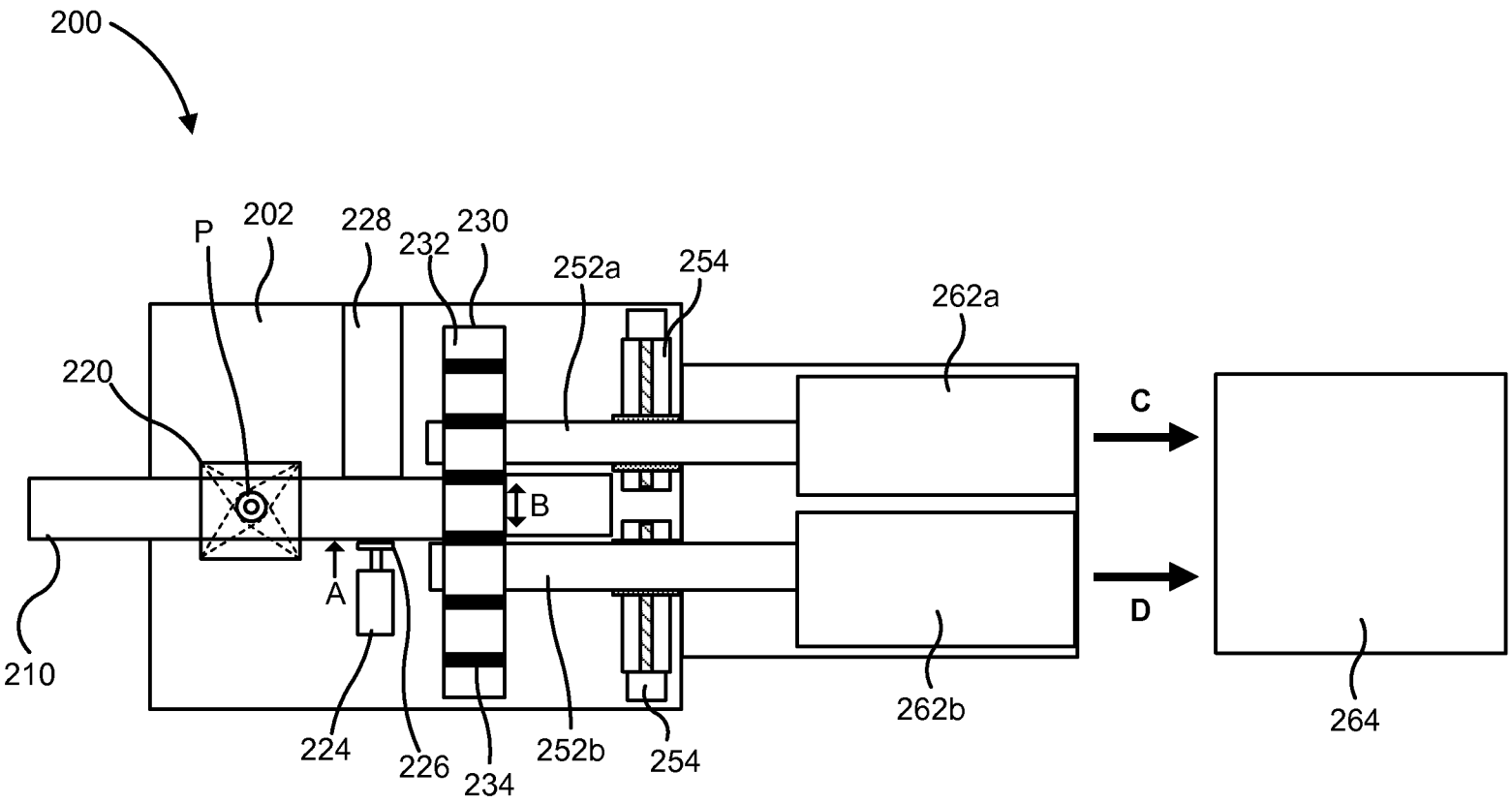
FIG. 1 is a schematic illustration of a serialization/aggregation system according to an embodiment.

Serialization is the process of creating and applying unique traceable serial numbers, for example, bar codes to goods, such as medical products, at each stage of a packaging and/or aggregation process. For example, the unique traceable serial numbers can be applied to containers (e.g., bottles, vials, boxes, cartons, etc.), bundles, cases, and pallets, etc. This information can be managed and exchanged with key stake holders in the product packaging line and supply chain to ensure that only authentic products are delivered to consumers. Examples of a serialization system for tracking and authenticating goods are described in U.S. patent application Ser. No. 13/507,320, filed Jun. 21, 2012, entitled "Systems and Methods for Tracking and Authenticating Goods," the disclosure of which is incorporated herein in its entirety (referred to herein as "the '320 application"). Most existing medical product manufacturers have relativity low speed manual packaging lines (e.g., 60-120 units per minute), for example, for packaging drug bottles and/or cartons, into bundles, cases and/or pallets.

In some embodiments, serialization/aggregation systems, devices and methods described herein can be easily integrated with existing medical product packaging lines to support multi-level track and trace capability for serialized products. Serialization/aggregation systems, devices and methods described herein provide several advantages including and not limited to, for example: (1) combination of manual and automated aggregation which can easily be integrated into current manual product packaging lines; (2) 360 degree imaging (e.g., bar code scanning) capability for reading bar codes on bottles, vials, or boxes, irrespective of orientation; (3) dual aggregation lines that increase throughput and also provide a backup in case one aggregation line is rendered inoperable; (4) a low maintenance diverter for diverting a predetermined quantity of product to each of the aggregation lines; (5) a rapidly adjustable diverter to match the width, depth and height of the product being aggregated; (6) non-contact bar code or human readable text readers provided at each packaging station; (7) compatibility with one level (i.e. bundle or case), two level (i.e. bundle and case), and three level (bundle, case, and pallet) aggregation requirements; and (8) easy integration with commercially available serialization based track and trace systems, for example, the serialization system described in the '320 application. The serialization and aggregation systems, devices and methods described herein can therefore allow a user to focus on packing the cartons without the hassle of complex handling to manually scan bar code on individual containers.

The term "about" generally means plus or minus 10% of the value stated, e.g. about 5 would include 4.5 to 5.5, about 10 would include 9 to 11, about 100 would include 90 to 110.

The term "aggregation" means physically collecting a quantity of units (also referred to herein as "product") at a given location, such that the aggregated product is ready for packaging. The term "aggregation" also refers to the digital linking or collating of all serial numbers of each packaging unit to the serial number of the next higher level of packaging (e.g. carton to case, and case to pallet).

FIG. 1 shows a schematic illustration of a serialization/aggregation system 200 for aggregation of serialized products such as, for example, medical products. The serialization/aggregation system 200 includes a conveyor 210, an imaging system 220, a diverter 230, a first packing station 262*a* and a second packing station 262*b*. The serialization/aggregation system 200 can be configured to aggregate a multitude of serialized products P of various shapes and sizes, for example, bottles, vials, cartons, boxes, bundled products, or any other suitable container. In some embodiments, the aggregation system 200 can be configured to aggregate a carton, box, and/or the like that has a height in the range of about ¾ inch to about 6 inches, a width of about 1 inch to about 8 inch, and a depth of about 1½ inch to about 5 inch. In some embodiments serialization/aggregation system 200 can be configured to aggregate a round bottle or a vial that has a height in the range of about 1½ inch to about 5 inches and a diameter of about ¾inch to about 2¼ inches. In some implementations, the serialization/aggregation system 200 can be configured to accept non-rectangular and non-circular shapes, such as ovals, ellipses, triangles, curvilinear shapes, parallelograms, trapezoid, pentagons, etc. The serialization/aggregation system 200 can also be configured to aggregate items of larger sizes, such as cartons, pallets, and the like. In such embodiments, the serialization/aggregation system can be configured to aggregate items of a height of about 6 inches, a width of about 8 inches, and a depth of about 5 inches. The serialized product P can be a medical product or any other product, for example, a consumer good.

Each of the components included in the serialization/aggregation system 200 can be mounted on a base 202. The base 202 can be substantially flat and can be made from a substantially rigid and sturdy material, for example, metals (e.g., stainless steel). The base 202 can be configured to minimize any vibrations produced by the components of the serialization/aggregation system 200. For example, the base 202 can have a mass sufficient to absorb vibrations and/or can be mounted on vibration dampers.

The conveyor 210 can be a belt conveyor, a chain conveyor, a roller conveyor, or any other suitable conveyor configured to receive and transport a product. The conveyor 210 can be made from a sufficiently wear resistant material (e.g., rubber, stainless steel, polyurethane, Kevlar, or any other suitable material). The width of the conveyor 210 can sufficient to accommodate the serialized product P of any cross section as described herein. In some implementations, the conveyor 210 can be large enough to accommodate all of the product sizes, as mentioned described above, where smaller products can fit within the parameters of the larger dimensions. In an alternative embodiment, the conveyor 210 may be adjustable. In some implementations, different sized conveyor belts can be placed on the conveyor 210. For example, a user may remove a conveyor belt and replace the conveyor belt with one of a different size based on the size of serialized product P. In another embodiment, the conveyor may have adjustable side walls and/or bumpers that can be adjusted based on the size of the product. For example, the side walls and/or bumpers may be slideable, moveable, and/or otherwise adjustable, such that the area of the conveyor 210 on which the products are placed can be expanded to accommodate larger product packaging, or may be contracted to accommodate smaller product packaging, In some such implementations, the size of the conveyor may stay the same, while the area of the conveyor between the side walls and/or bumpers may be reduced, as needed, and may be expanded to the full width of the conveyor 210. The speed of the conveyor 210 can be adjusted in accordance with a desired throughput of the serialization/aggregation system 200.

The imaging system 220 can include a plurality of imaging devices (not shown), for example, cameras, bar code scanners, RFID scanners, and/or the like. The plurality of imaging devices included in the imaging system 200 can be oriented such that the imaging system can scan a serialized bar code or read a serialized human readable code on the serialized product moving on the conveyor irrespective of the orientation and/or physical dimension of the serialized product P. The imaging system 220 is operative to scan the bar code on the serialized product P with sufficient speed, such that the bar code can be scanned as the serialized product P is moving along the conveyor 210. Furthermore, the fidelity of the bar code scan or serialized human readable code is not affected by the speed at which the serialized product is moving on the conveyor 210.

The serialized bar code or serialized human readable code information can be communicated by the imaging system 220 to a serialization authentication system, for example, the serialization system described in the '302 application, and digitally transferred to a packaging line server, for subsequent to a facility site server and cloud-based data base. In some embodiments, this information may be digitally transferred directly through a processor and/or computer connected to the serialization/aggregation system 200, while in other embodiments the information may be transferred via Bluetooth, WiFi, and/or the like. If the serialized information on the serialized product P does not match the information in the serialized authentication system and/or if the imaging system 220 fails "read" the serialized bar code or serialized human readable code, the serialized product P is rejected, and pushed off the conveyor 210 by a rejection actuator 224. The rejection actuator 224 can be any suitable actuator. For example, in some embodiments, the rejection actuator 224 can include a plunger 226 configured to push a rejected serialized product P in a direction shown by the arrow A off the conveyor 210 and onto a rejection line 228. The rejection line 228 can be a conveyor or a hopper configured to transport the rejected serialized product P to a rejected product collection station (not shown). In some embodiments, the rejection line 228 can be at an angle (e.g., a right angle) with respect to the feed conveyer 210 such that the rejected product is diverted off the feed conveyer 210 by the rejection actuator 224. In other embodiments, the rejection line 228 can be "inline" such that the rejected product simply passes through the serialization/aggregation system 200 (e.g., on the feed conveyer 210) bypassing the diversion/aggregation sub-system.

Figure 2:
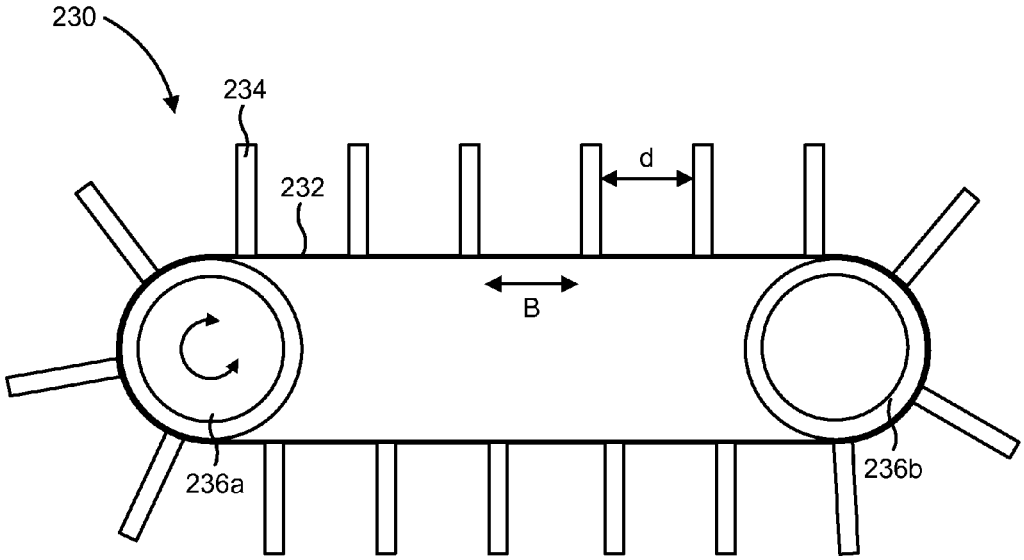
FIG. 2 is a side view of a diverter included in the serialization system shown in FIG. 1 according to an embodiment.
Figure 3:
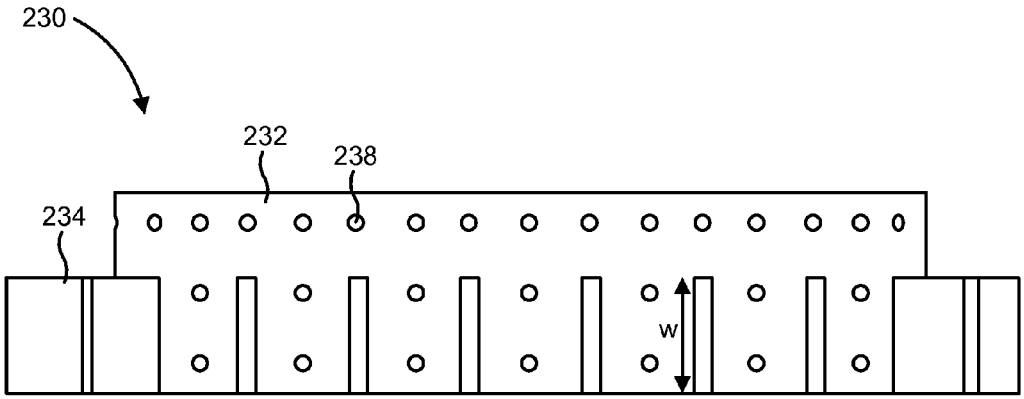
FIG. 3 is a top view of the diverter of FIG. 2

Authenticated serialized products P move on the conveyor 210 to the diverter 230. In some embodiments, the diverter 230 diverts the serialized product P to either one of the first packing station 262*a* or the second packing station 262*b*. For example, the diverter 230 can be a diverter gate with a rotating belt to maintain product orientation for rectangle products or an overhead diverter. FIG. 2 shows a side view of one exemplary embodiment of the diverter 230 that can be included in the serialization/aggregation system 200 and FIG. 3 shows a top view of the diverter 230. As shown herein, the diverter 230 includes a movable belt 232 and a plurality of paddles 234 that are removably and/or movably coupled to the belt 232. The belt 232 can be made from a sufficiently wear resistant material, for example, rubber, reinforced rubber, polyurethane, Kevlar, or the like. The belt 232 can be mounted on a first drum 236*a* and a second drum 236*b* (collectively referred to herein as "drums 236"). In some embodiments, the belt 232 can be friction fit on the drums 236. In such embodiments, the belt 232 can be relatively flexible. In some embodiments, the belt 232 can include a plurality of ridges on a surface of the belt 232 in contact with the drums 236. In such embodiments, the drums 236 can include corresponding grooves, shaped and sized to receive the plurality of ridges of the belt 232, so that the belt 232 can be moved by the drums 236 without any slip. Any one of the drums 236, for example, the first drum 236*a* can be coupled with a motor (not shown) configured to rotate the drums 236 in a clockwise and/or a counter clockwise direction such that the belt 232 can run laterally about the drums 236 as shown by the arrow B in FIG. 2.

Each of the plurality of paddles 234 disposed on the belt 232 has a width w. The paddles 234 are disposed on the belt 232 with an inter-paddles spacing d. The width w of the paddles 234 can be modified to accommodate serialized products P having a wide range of dimensions as described herein. The inter-paddle spacing d can also be configured to accommodate serialized products P of different dimensions and/or to adjust a throughput of the diverter 230. In some embodiments, the throughput of the diverter 230 can be controlled by simply varying the rotational speed of the motor coupled to any one of the drums 236 (e.g., drum 236*a*). As shown in FIG. 3, the belt includes a plurality of holes 238 configured to allow the plurality of paddles 234 to be reversibly coupled to the belt 232 via screws, bolts, nuts, press fit, or any other suitable mounting mechanism. The holes 238 can be arranged in an array on the belt 232 such that the plurality of paddles 234 having a variety of widths w can be mounted on the belt 232 with varying inter-paddle spacing d to adjust for serialized products P of varying dimensions. Furthermore, reversible coupling allows damaged or worn paddles 234 to be easily removed from the belt 232 without changing the belt 232. In some embodiments, the paddles 234 can be fixedly coupled to the belt 232 and a plurality of belts 232 can be easily interchangeable to allow fast and efficient changeover of the diverter 230 for products P of varying dimensions.

The diverter 230 is disposed above the conveyor 210 and oriented orthogonally with respect to a direction of the motion of the conveyor 210. The rotation of the drums 236 can be selected such that the belt 232 runs laterally in a direction shown by arrow B (FIG. 1) towards either a first aggregation line 252*a* or a second aggregation line 252*b*. The displacement of the belt 232 causes the plurality of paddles 234 to also move over the conveyor 210 orthogonal to the direction of motion of the conveyor 210, such that the each of the plurality of paddles 234 pushes the serialized product P towards either the first aggregation line 252*a* or the second aggregation line 252*b*, depending on the direction in which the belt 232 is moving. The diverter 230 can be configured to divert a predetermined quantity of serialized products P in a given period of time, for example, 30 products per minute, 60 products per minute, 90 products per minute, 120 products per minute, or any other predetermined quantity of serialized product P at a predetermined throughput, towards either first aggregation line 252*a* or the second aggregation line 252*b*. In some embodiments, the diverter 230 can be configured to alternately divert a first predetermined quantity of serialized product P towards the first aggregation line 252*a*, followed by a second predetermined quantity of serialized product P towards the second aggregation line 252*b*. In some embodiments, the diverter 230 can be configured to divert the predetermined quantity of the serialized product P towards only one of the aggregation lines 252. For example, if either one the aggregation lines 252*a* or 252*b* is disabled, or if a user is away from one of the first packing station 262*a* or second packing station 262*b*.

The first aggregation line 252*a* and the second aggregation line 252*b* (collectively referred to herein as "aggregation lines 252") are configured to transport the predetermined quantity of serialized products P (i.e., the first quantity and the second quantity) to the first packing station 262*a* and the second packing station 262*b*, respectively. The aggregation lines 252 can include conveyors, rails or hoppers. Each of the first aggregation line 252*a* and the second aggregation line 252*b* include an adjustment mechanism 254 coupled thereto. The adjustment mechanism 254 can, for example, be a simple ball screw adjustment with a dial indicator feedback, and can be configured to vary a dimension of the aggregation lines 252. In some embodiments, the adjustment mechanism 254 can be used to adjust the conveyor center lines, rail opening or hopper width, for example, to adjust for serialized products P of various width and height. In some embodiments, the adjustment for the range of serialized product P sizes as described herein, at the diverter 230 stage and/or the aggregation line 252 stage can be performed within 30 minutes or less.

The predetermined quantity of the serialized product P is then transported on the aggregation lines 252 to each of the first packing station 262*a* and the second packing station 262*b* where the predetermined quantity of serialized product P is aggregated. Each of the packing stations can have an ergonomic design and can have a manual bar code scanner coupled thereto or disposed thereon. In some embodiments, a user can be positioned at each of the packing stations 262 to manually pack the pre-aggregated serialized product P into a bundle or a case. In some implementations, the serialization/aggregation system may load the serialized product P into bundles, cases, pallets, and/or the like. The bundle or case can include a pre-printed bar code, for example a serialized bar code produced by a serialization system (e.g., the serialization system described in the '302 application). The user can then scan the bar code on the bundle or case which is associated with the aggregated serialized product P within the bundle or case.

In some embodiments, the bundles or cases of aggregated serialized product P from each of the packing stations 262 can further be transferred to pallets on a palletizing station 264 for further aggregation, as shown by the arrows C and D. In other embodiments, the serialized bundle can be transferred to a serialized case and/or the cases of aggregated serialized product P from each of the packing stations 262 can further be transferred by a user to the pallets on a palletizing station 264 for aggregation, as shown by arrows C and D. Each pallet can also include a pre-printed serialized bar code. The bar code can be scanned, which when scanned, is associated with bundle or case being palletized, and each of the aggregated serialized products P contained therein. In some embodiments, the aggregated serialized product P can be first packaged into bundles, which can then be further aggregated for packing into cases. This second level packing can be performed manually or automated using the aggregation system 200. The cases can then be manually aggregated on pallets at the palletizing station 264. In this manner, the smallest unit, i.e. a single serialized product can be traced back to its point of origin if the bar codes of any of the higher levels of packaging are scanned. In some implementations, a user may scan the bar codes, while in other implementations, a second implementation of the serialization/aggregation system may be used to scan and sort the secondary levels of packaging. In some implementations, a third implementation and tertiary level of packaging may also be used.

Figure 4:
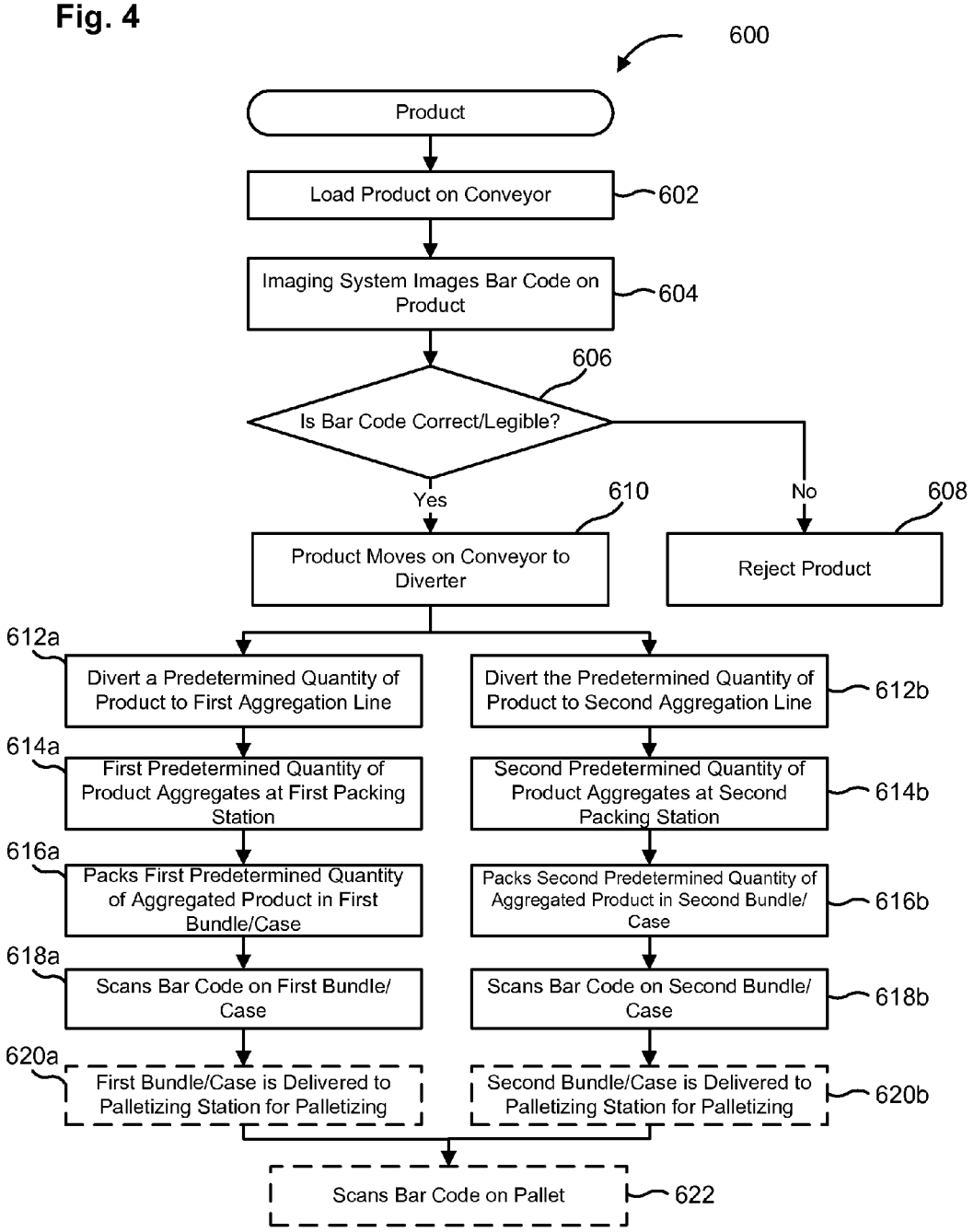
FIG. 4 illustrates a flow diagram showing a method of serializing and aggregating serialized goods.

FIG. 4 illustrates a flow diagram showing an exemplary method for serializing and aggregating serialized products using a serialization/aggregation system, for example the aggregation system 200 described herein. A product, for example, serialized product P described with reference to FIG. 1 or any of the serialized products described herein, is loaded on a conveyor 602 (e.g., conveyor 210). The conveyor transports the serialized product to an imaging system, e.g., imaging system 220, where a plurality of imaging devices, included in the imaging system, image or scan the bar code on the product 604. The bar code information can be communicated to a serialization data base, for example, the serialization data base described in the '320 application, which determines if the bar code is correct or legible 606. If the bar code is incorrect or illegible, the product is rejected 608, for example, by the rejection actuator 224. If the bar code is correct, the product moves on the conveyor to the diverter 610, for example, the diverter 230. The diverter diverts a first predetermined quantity of the serialized product to a first aggregation line 612*a* and then a second predetermined quantity of the serialized product to a second aggregation line 612*b*, for example, the first aggregation line 252*a* and the second aggregation line 252*b* described with reference to FIG. 1. The first aggregation line and the second aggregation line transport the first predetermined quantity of product and the second predetermined quantity of product to a first packing station and a second packing station respectively, for example, the packing stations 254. The first predetermined quantity of product aggregates at the first packing station 614*a*. Similarly, the second predetermined quantity of product aggregates at the second packing station 614*b*. In some embodiments, a first user stationed at the first packing station packs the first predetermined quantity of aggregated product in a first serialized bundle or case 616*a*. In other embodiments, the serialization/aggregation system may pack the first predetermined quantity of aggregated product into a first serialized bundle or case. In some implementations, a second user stationed at the second packing station packs the second predetermined quantity of aggregated product in a second serialized bundle or case 616*b*, while in other implementations, the serialization/aggregation system may pack the second predetermined quantity of aggregated product into a second serialized bundle or case. The first user and/or the serialization/aggregation system may scan a bar code affixed on the first bundle or case 618*a* and similarly, the second user and/or the serialization/aggregation system scans a bar code affixed on the second bundle or case 618*b*. Optionally the first bundle or case can be delivered to a palletizing station for palletizing 620*a* and similarly, the second bundle or case can also be delivered to the palletizing station for palletizing 620*b*. In some implementations, the serialization/aggregation system may palletize the first bundle or case and the second pallet or case. A third user and/or the serialization/aggregation system can then scan a bar code on a serialized pallet 622 on which the bundles or cases are aggregated.

Although various embodiments have been described as having particular features and/or combinations of components, other embodiments are possible having a combination of any features and/or components from any of embodiments as discussed above.

The invention claimed is:

1. An apparatus for aggregating authentic goods, said apparatus comprising:

a conveyor configured to receive and transport a first item;

an imaging system configured and disposed to automatically capture a field image of at least one portion of the first item, the at least one portion expected to feature a unique signature associated with the first item, the unique signature predetermined to distinguish the first item from other items;

at least one processor configured to analyze data associated with the field image to verify the authenticity of the first item based on the unique signature; and a diverter configured and disposed to at least one of:

divert the first item from the conveyor to an aggregation line if the first item is verified as authentic; and divert the first item from the conveyor to a rejection line if the first item fails to be verified as authentic, wherein the apparatus is configured to receive items of various shapes and sizes.

2. The apparatus of claim 1, wherein the diverter comprises:

a belt configured to rotate around two drums; and a plurality of paddles, each paddle connected to the belt via at least one mounting mechanism.

3. The apparatus of claim 2, wherein the paddles are disposed at about equal spacing around said belt.

4. The apparatus of claim 2, wherein the belt is configured to receive paddles of varying sizes.

5. The apparatus of claim 2, wherein the two drums are configured to receive belts of varying widths.

6. The apparatus of claim 2, wherein each paddle is adjustably fastened to the belt via the mounting mechanism.

7. The apparatus of claim 2, wherein each paddle is removably fastened to the belt via the mounting mechanism.

8. The apparatus of claim 7, wherein the belt defines plurality of holes and the mounting mechanism includes at least one of a screw, a bolt, a nut, and a press fit.

9. The apparatus of claim 1, wherein the conveyor is surrounded by side walls, said side walls adjustable to accommodate the items of various shapes and sizes.

10. The apparatus of claim 1, wherein the unique signature is electronically associated with a serialization code indicating an instruction for capturing the field image of the unique signature.

11. The apparatus of claim 10, wherein the imaging system is configured to capture the serialization code for capturing the field image of the unique signature associated with the first item according to the instruction indicated by the serialization code.

12. The apparatus of claim 11, wherein the apparatus is coupled with at least two aggregation lines such that, if the first item is verified as authentic, the diverter is configured and disposed to divert the first item from the conveyor to one of the at least two aggregation lines based on at least one of a.

13. A method for aggregating authentic goods, comprising:

receiving a first item at a conveyor and transporting the first item via the conveyor;

automatically capturing a field image of at least one portion of the first item with an imaging system, the at least one portion expected to feature a unique signature associated with the first item, the unique signature predetermined to distinguish the first item from other items;

analyzing, via at least one processor, data associated with the field image to verify the authenticity of the first item based on the unique signature; and if the first item is verified as authentic, diverting the first item, via a diverter, from the conveyer to an aggregation line.

14. The method of claim 13, further comprising, if the first item fails to be verified as authentic, diverting the first item from the conveyor to a rejection line.

15. The method of claim 13, wherein the aggregation line includes a packing station.

16. The method of claim 13, wherein the diverter comprises a rotating belt and a plurality of paddles, wherein the paddles are removably attached to the rotating belt.

17. The method of claim 16, wherein the rotating belt defines includes a plurality of holes, and the paddles are attached to the belt via an attachment mechanism that includes at least one of a screw, a bolt, a nut, and a press fit.

18. The method of claim 13, wherein the diverter maintains an orientation of the first item.

19. The method of claim 13, further comprising adjusting at least one of the conveyor and the diverter to accommodate at least one of a shape and a size of the first item.

20. A method for aggregating authentic goods, comprising:

loading a plurality of items onto a conveyor and transporting the items via the conveyor;

automatically capturing a field image of at least one portion of each item with an imaging system, each at least one portion expected to feature a unique signature associated with an item, each unique signature predetermined to distinguish the item from the rest of the plurality of items;

analyzing, via at least one processor, data associated with each field image to verify the authenticity of each item based on its unique signature;

if an item fails to be verified as authentic, diverting the item from the conveyor to one of at least one rejection line; and if an item is verified as authentic, diverting the item from the conveyor to one of at least one aggregation line until a predetermined quantity of verified authentic items have been diverted to the least one aggregation line.

21. The method of claim 20, further comprising:

packing the predetermined quantity of the verified authentic items into a bundle via at least one packing station coupled to the at least one aggregation line;

determining a unique bundle signature associated with the packed bundle to distinguish the packed bundle from other bundles; and registering the unique bundle signature via the at least one processor.

22. The method of claim 21, further comprising:

loading the packed bundle onto the conveyor and transporting the packed bundle via the conveyor;

automatically capturing a field image of at least one portion of the packed bundle with the imaging system, the at least one portion expected to feature the unique bundle signature associated with the packed bundle;

analyzing, via the at least one processor, data associated with the field image to verify the authenticity of the packed bundle based on the unique bundle signature; and if the packed bundle is verified as authentic, diverting the packed bundle, via the diverter, from the conveyer to the at least one aggregation line.

23. The method of claim 22, wherein analyzing the data associated with the field image comprises comparing a unique bundle signature captured in the field image with the registered unique bundle signature.

24. The method of claim 20, wherein the plurality of items includes at least one of a bottle, a vial, a carton, a box, a bundle, a case, and a pallet.

* * * * *